United States Patent [19]

Wierszewski

[11] 4,085,673

[45] Apr. 25, 1978

[54] SHEET FEEDING APPARATUS

[75] Inventor: Ronald R. Wierszewski, Henrietta, N.Y.

[73] Assignee: Xerox Corporation, Stamford, Conn.

[21] Appl. No.: 496,503

[22] Filed: Aug. 12, 1974

[51] Int. Cl.[2] ..... B41F 21/04

[52] U.S. Cl. ..... 101/242; 101/408; 271/247

[58] Field of Search ..... 101/242, 241, 239, 246, 101/408–411; 271/245–247

[56] References Cited

U.S. PATENT DOCUMENTS

| | | | |
|---|---|---|---|
| 640,799 | 1/1900 | North | 271/247 |
| 1,161,251 | 11/1915 | Robertson | 271/247 |
| 1,515,791 | 11/1924 | Redner | 101/242 |
| 1,867,859 | 7/1932 | Mollet | 101/242 |
| 2,221,500 | 11/1940 | Upham | 271/247 |
| 2,899,202 | 8/1959 | Mestre | 271/247 |
| 3,256,009 | 6/1966 | Reilly | 271/246 |

*Primary Examiner*—J. Reed Fisher
*Attorney, Agent, or Firm*—J. J. Ralabate; C. A. Green; H. Fleischer

[57] ABSTRACT

A sheet feeding apparatus in which successive sheets are separated and advanced from a stack thereof. As the sheet advances from the stack, it is aligned. After alignment, a conveyor moves the sheet to a delivery station. The aligning mechanism moves into the sheet path in response to the conveyor reaching a first predetermined position. When the conveyor moves to a second predetermined position, the aligning mechanism is spaced from the sheet path.

6 Claims, 4 Drawing Figures

SHEET FEEDING APPARATUS

BACKGROUND OF THE INVENTION

This invention relates generally to an electrostatographic printing machine, and more particularly concerns an improved sheet feeding apparatus for use therein.

The art of electrostatographic printing includes both electrographic printing and electrophotographic printing. In both of these processes, an electrostatic latent image, which corresponds to the original document being reproduced, is recorded. Electrophotography achieves this by charging a photoconductive surface to a substantially uniform potential. The charged photoconductive surface is exposed to a light image of the original document. As a consequence of this exposure, the charge is selectively dissipated in the irradiated areas in accordance with the light intensity reaching the photoconductive surface. This creates an electrostatic latent image thereon. Electrographic printing differs from electrophotographic printing only in that the electrostatic latent image is created without the use of photoconductive material. Hence, the process of electrophotographic printing requires the use of a suitable photoconductor whereas electrography does not. The electrostatic latent image created in electrophotography or electrography is developed with a developer mix. Generally, a suitable developer mix comprises colored heat settable plastic particles, known in the art as toner particles mixed with carrier granules, such as ferromagnetic granules. The toner particles and carrier granules are triboelectrically attracted to one another with the toner particles adhering to the outer surface of the carrier granules. As the developer mix contacts the latent image, the greater attractive force of the latent image causes the toner particles to transfer thereto from the carrier granules.

After the toner powder image is formed on the electrostatic latent image, it may be transferred to a sheet of support material. The sheet of support material is frequently advanced from a stack thereof. This is achieved by a sheet feeding apparatus which advances and separates successive sheets from the stack. As the sheet advances, it is aligned to insure that the toner powder is transferred thereto in proper orientation.

Hereinbefore, various techniques were employed to align the advancing sheet. For example, U.S. Pat. No. 3,100,109 issued to Eichorn in 1963 and U.S. Pat. No. 3,199,866 issued to Eichorn et al. in 1965 disclose a sheet of support material forwarded into a paper guide by the action of separator rolls. The sheet of support material is buckled as the separator rolls continue to advance the sheet after the forward motion thereof has been arrested by a gate in the paper path. A paper gripper disposed on a chain advances over the guide and opens the gate. Substantially simultaneously therewith a cam follower on the sheet gripping mechanism opens the individual jaws of the paper gripper so as to receive the sheet heretofore stopped by the registration gate. After the sheet is secured to the paper gripper, the gate then closes exerting a drag force on the sheet of paper being pulled therethrough by the sheet grippers. If the drag is too high, it pulls the paper from the sheet grippers and prevents it from being advanced.

Contrawise, if the gate force is too light, a sheet of substantially stiff paper will push the gate open without being aligned. Thus, the force exerted by the registration gate must be optimumly designed in view of the fact that the drag must be minimal while the sheet is advancing therepast. However, the force in the closed position must be sufficient to prevent a stiff sheet of paper from moving the registration gate out of position prior to the alignment thereof. The foregoing contradictory requirements are difficult to achieve in a sheet feeding apparatus and, frequently, when not attained, result in paper jams and sheet misfeeds within the electrophotographic printing machine. This results in excessive machine downtime and increased maintenance costs.

Accordingly, it is a primary object of the present invention to improve the sheet feeding apparatus by achieving a more efficient registration system therefor.

SUMMARY OF INVENTION

Briefly stated and in accordance with the present invention, there is provided an improved sheet feeding apparatus arranged to separate and advance successive sheets from a stack thereof.

Pursuant to the present invention, this is achieved by providing means for conveying successive sheets being advanced from the stack thereof to a delivery station. Operatively associated with the conveying means is means for aligning successive advancing sheets. Moving means are responsive to the conveying means being positioned at first and second preselected positions. When the conveying means is positioned at the first preselected position, the moving means disposes the aligning means in the operative position in the path of sheet movement. After the sheet is aligned and the conveying means has advanced to a second preselected position, the moving means returns the aligning means to the inoperative position spaced from the path of sheet movement.

BRIEF DESCRIPTION OF THE DRAWINGS

Other objects and advantages of the present invention will become apparent upon reading the following detailed description and upon reference to the drawings, in which.

While the present invention will hereinafter be described in connection with a preferred embodiment, it will be understood that it is not intended to limit the invention to that embodiment. On the contrary, it is intended to cover all alternatives, modifications and equivalents that may be included within the spirit and scope of the invention as defined by the appended claims.

DETAILED DESCRIPTION OF THE INVENTION

Figure 1:
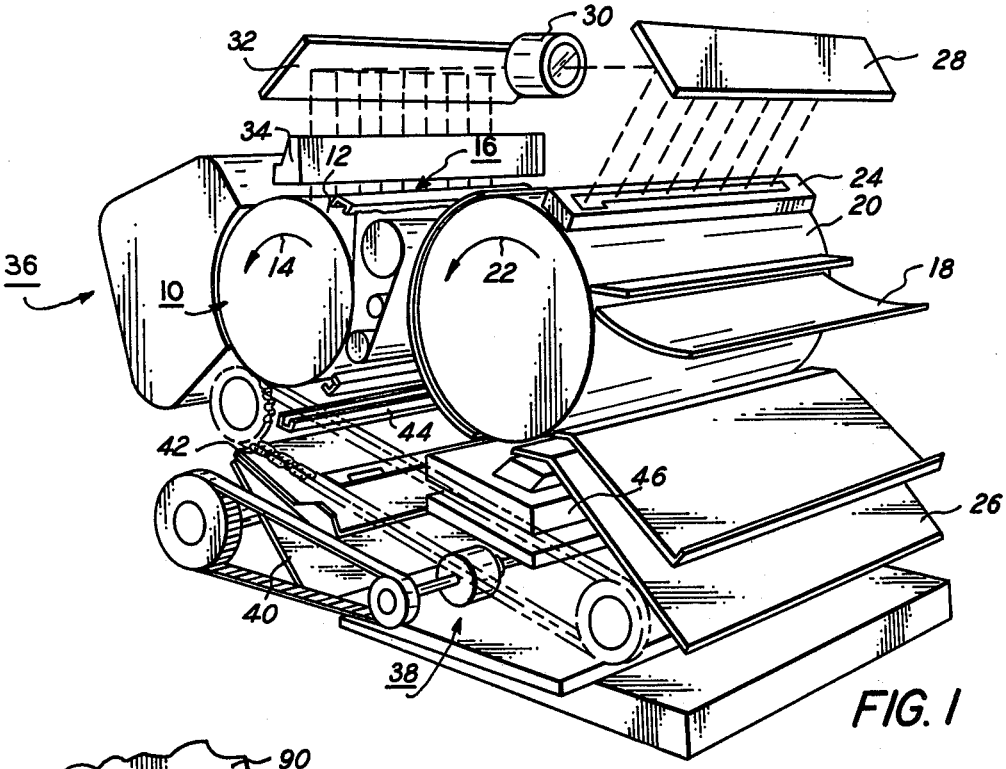
FIG. 1 is a schematic perspective view of an electrophotographic printing machine incorporating the features of the present invention therein.

A general understanding of an electrophotographic printing machine, in which the present invention may be incorporated, is had by referring to FIG. 1. FIG. 1 schematically illustrates the various components of an electrophotographic printing machine adapted to employ the features of the present invention therein. Continued reference will hereinafter be made to the drawings wherein like reference numerals have been used throughout to designate like elements. Although the apparatus of the present invention is particularly well adapted for use in an electrophotographic printing machine, it should become evident from the following discussion that it is equally well suited for use in a wide variety of sheet feeding devices and is not necessarily limited in its application to the particular embodiment shown herein.

Referring now to FIG. 1, the printing machine described therein employs a drum 10 having a photoconductive surface 12 entrained about and secured to the circumferential surface thereof. A synchronous speed motor (not shown) rotates drum 10 in the direction of arrow 14. As drum 10 rotates, photoconductive surface 12 passes sequentially through a series of processing stations. These processing stations will be described hereinafter briefly.

First, drum 10 rotates in the direction of arrow 14 to move photoconductive surface 12 through charging station A. At charging station A, a corona generating device, indicated generally by the reference numeral 16, extends in a generally longitudinal direction transversely across photoconductive surface 12. In operation, corona generating device 16 charges photoconductive surface 12 to a relatively high, substantially uniform potential. A suitable corona generating device is described in U.S. Pat. No. 2,832,725 issued to Vyverberg in 1958.

After photoconductive surface 12 is uniformly charged, drum 10 rotates to exposure station B. At exposure station B, an original document passes through chute 18 and is grasped by grippers (not shown) mounted on document drum 20. The grippers hold the original document against drum 20. Drum 20 rotates in the direction of arrow 22 and pulls the original document into the machine under exposure lamps 24. Exposure lamps 24 are located above document drum 20 and illuminate incremental areas of the document as drum 20 rotates. After exposure, the grippers release the original document which passes through chute 26 into a catch tray (not shown). The catch tray is situated so as to enable the operator to readily remove the original document from the printing machine. The light image of the original document is reflected by object mirror 28 through a stationary lens 30 to image mirror 32. Image mirror 32 reflects the light image through exposure slit 34 onto charged photoconductive surface 12. As the light image irradiates areas of charged photoconductive surface 12, selected portions thereof discharge to record thereon an electrostatic latent image corresponding to the original document.

After the electrostatic latent image is recorded on photoconductive surface 12, drum 10 rotates to development station C. At development station C, the electrostatic latent image recorded on photoconductive surface 12 is rendered visible by depositing toner particles thereon. In the development system, a developer mix of carrier granules, i.e. ferromagnetic granules, and toner particles, i.e. heat settable thermoplastic particles, are brought into contact with the electrostatic latent image. The toner particles are attached to the electrostatic latent image from the carrier granules. This forms a powder image on photoconductive surface 12. The apparatus adapted to develop the electrostatic latent image is referred generally to by the reference numeral 36. Numerous types of development systems are suitable for rendering the electrostatic latent image visible. For example, cascade systems, magnetic brush systems, or toner powder cloud systems may be employed. However, in the apparatus depicted in FIG. 1, a cascade system is utilized. A suitable cascade development system is disclosed in co-pending application Ser. No. 479,706 filed in 1974, the relevant portions of the disclosure being hereby incorporated into the present application.

At the proper time during the machine cycle, a pair of feed rollers, indicated generally by the reference numeral 38, move from the inoperative position spaced from the uppermost sheet of the stack of support material to the operative position in contact therewith. The feed rollers advance the uppermost sheet into chute 40. A registration member aligns the advancing sheet. A pair of gripper bars mounted on chain 42 receive the aligned sheet and advances it to transfer station D. The sheet feeding apparatus of the present invention will be described hereinafter, in greater detail, with reference to FIGS. 2 through 4, inclusive. The feed roll depicted in FIG. 1 is described in greater detail in co-pending application Ser. No. 460,627 filed in 1974, the disclosure of which is hereby incorporated into the present application.

At transfer station D, the gripper bars advance the sheet of support material between drum 10 and corona generating device 44. Corona generating device 44 applies an electrostatic charge to the sheet of support material to attract thereto the toner powder image adhering to photoconductive surface 12. The gripper bar continually moves the sheet of support material through transfer station D. After the entire toner powder image has been transferred to the sheet of support material, the gripper bars advance the sheet of support material, with the toner powder image adhering thereto, to fixing station E.

At fixing station E, a fuser, indicated generally by the reference numeral 46, affixes substantially permanently the toner powder image to the sheet of support material advancing therethrough. Fuser 46 includes suitable radiant heating elements and control circuits for maintaining the temperature thereof substantially constant so as to affix the powder image to the sheet of support material. A suitable fusing system is described in co-pending application Ser. No. 483,749 filed in 1974, the disclosure of which is hereby incorporated into the present application. After exiting fuser 46, the sheet of support material passes to the catch tray. Once the sheet is in the catch tray, it may be readily removed therefrom by the machine operator.

Continuing now with the printing process, drum 10 next passes through cleaning station F. At cleaning station F, a pre-cleaning corona generating device 48 applies a charged potential to photoconductive surface 12. This neutralizes the remaining charge on photoconductive surface 12 as well as the charge remaining on the residual toner particles adhering thereto. Web cleaning system 50, then removes the residual toner particles from photoconductive surface 12. Photoconductive surface 12 is now ready for the next machine cycle. The foregoing machine cycle is repeated for each successive copy being reproduced.

It is believed that the foregoing description is sufficient for the purposes of the present application to illustrate the general operation of an electrophotographic printing machine embodying the teachings of the present invention therein.

Figure 2:
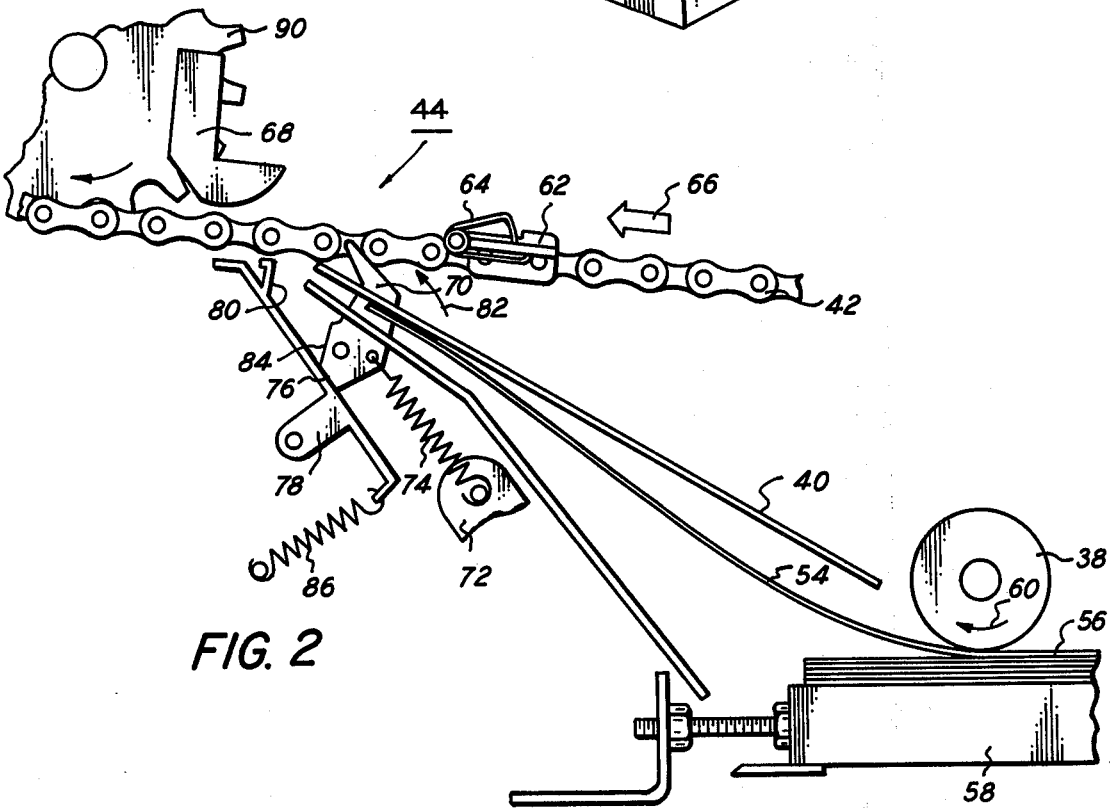
FIG. 2 is a schematic elevational view depicting the sheet feeding apparatus with the registration member in the inoperative position spaced from the path of sheet movement.

Turning now to FIG. 2, there is shown the detailed structure of the sheet feeding apparatus depicted generally by the reference numeral 52. As shown therein, feed roll 38 engages the uppermost sheet 54 of stack 56 disposed upon tray 58. Feed roll 38 rotates in the direction of arrow 60 to advance sheet 54 into chute 40. As shown in FIG. 2, gripper 44 includes a gripper bar 62 adapted to extend substantially between two roller chains 42 being connected thereto by clips forming part of the chain 42. The clips are formed to support the gripper bar so that the top surface of gripper bar 62 is positioned slightly below the pitch line of the chains, whereby gripper bar 62, as it passes beneath drum 10, will not contact the peripheral surface thereof.

A concave sheet gripper jaw 64 extends across the rear of gripper bar 62. Gripper jaw 64 is positioned to have surface contact with the leading edge of a sheet of support material as it is advanced from chute 40. Gripper jaws 64 are adapted to grip a sheet of support material inserted therebetween. Each gripper jaw 64 is mounted rotatably by means of pins suitably secured to the leading edge of gripper bar 62. Springs normally bias the jaws of the gripper in an upwardly direction, as depicted in FIG. 2. Chains 42 advance gripper jaw 64 in the direction of arrow 66. Cam 68 engages the upper surface of gripper jaw 64 moving it to an open position (as shown in FIG. 4) so as to permit a sheet of support material to be received therein. Cam 68 is mounted stationarily on the printing machine frame. After chains 42 advance the gripper mechanism from beneath cam 68, jaws 64 return to the position depicted in FIG. 2 with the sheet of support material interposed between and secured thereto so as to be advanced to transfer station D. As jaw 64 advances in the direction of arrow 66, it engages cam 70. Cam 70 is mounted pivotably on the machine frame and is resiliently urged by spring 74 secured to frame 72 to the position shown in FIG. 2. As illustrated in FIG. 2, surface 76 of cam 70 engages registration member 78. Registration member 78 is also mounted pivotably on the machine frame and includes a generally planar transverse surface 80 adapted to align or contact the advancing sheet when in the operative position. In FIG. 2, registration member 78 is in the inoperative position. When bar 62 engages cam 70, cam 70 pivots in the direction of arrow 82. The pivoting of cam 70 positions surface 84 in contact with registration member 78. The foregoing is shown in FIG. 3.

Figure 3:
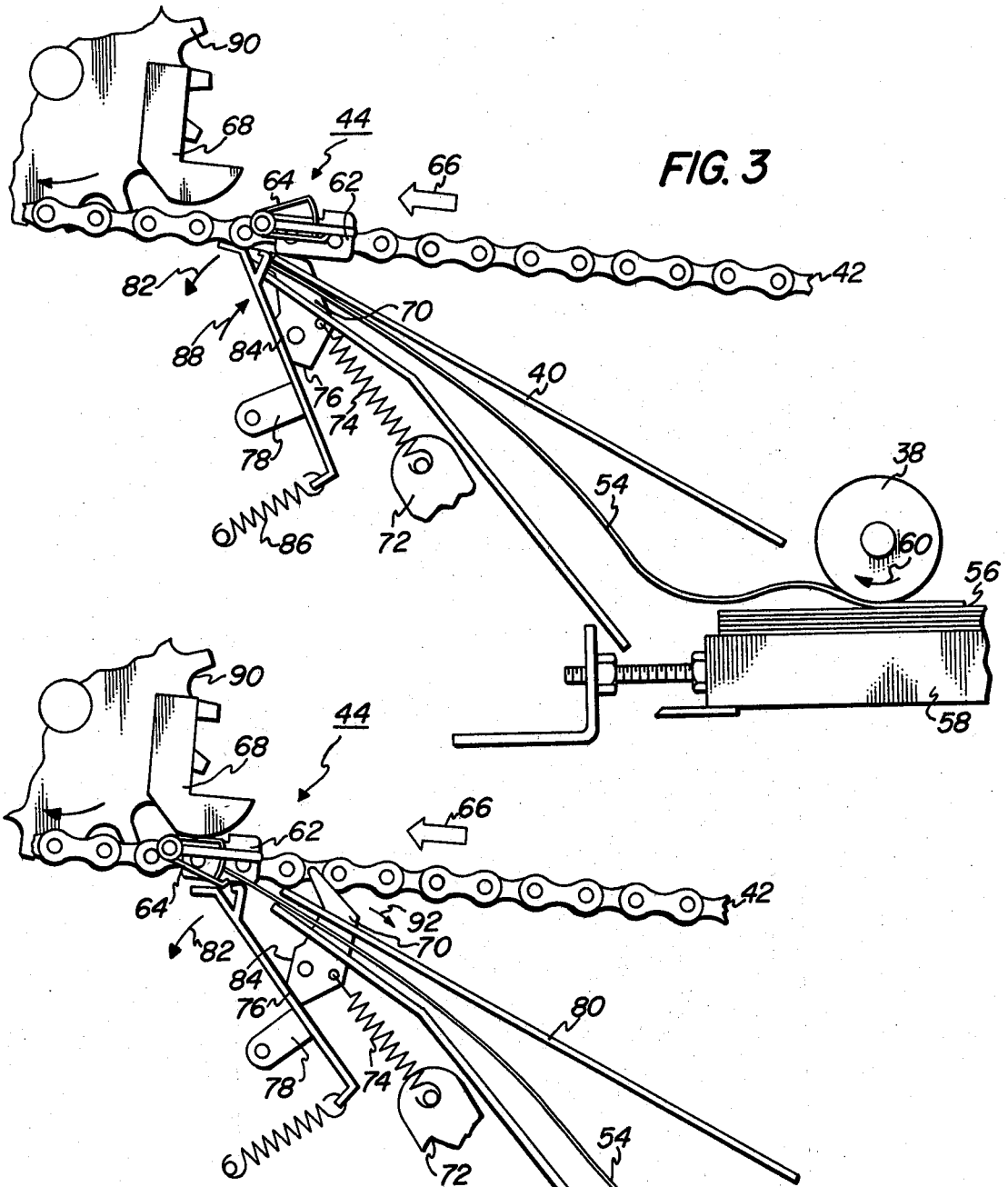
FIG. 3 is a schematic elevational view showing the registration member of the FIG. 2 sheet feeding apparatus in the operative position in the path of sheet movement aligning the advancing sheet.
Figure 4:
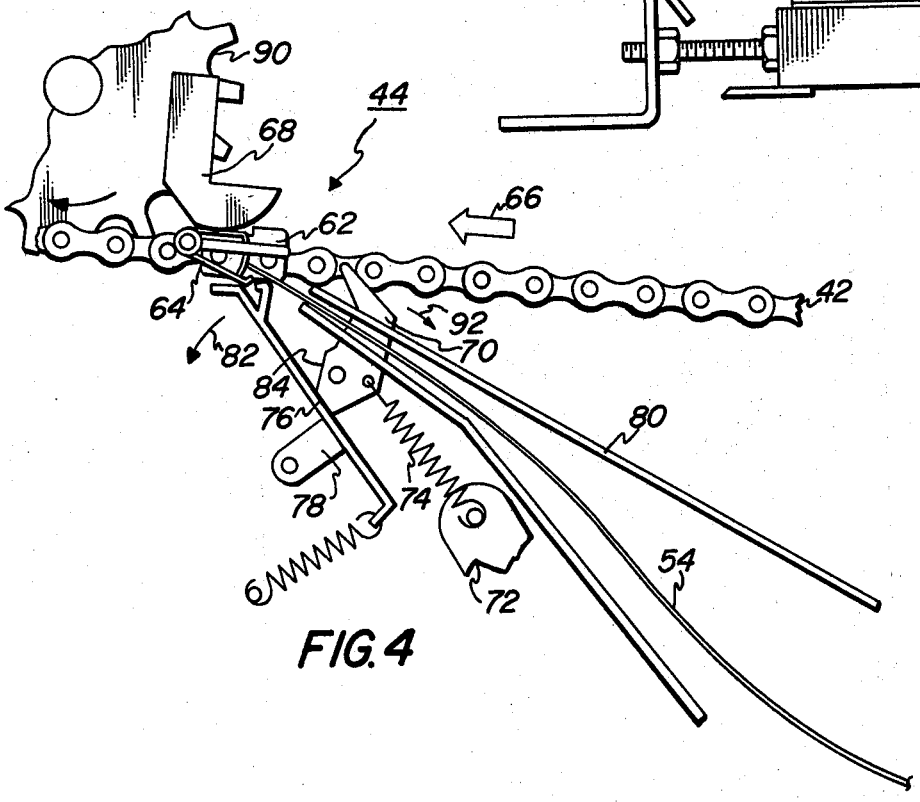
FIG. 4 is a schematic elevational view illustrating the registration member of the FIG. 2 sheet feeding apparatus returning to the inoperative position after aligning the advancing sheet.

Turning now to FIG. 3, the detailed operation of the registration system will be further described. As shown in FIG. 3, bar 62 engages cam 70 rotating cam 70 in the direction of arrow 82. As ca 70 rotates in the direction of arrow 82, surface 84 rather than surface 76 moves into engagement with registration member 78. This permits spring 86 to pivot registration member 78 in the direction of arrow 88. Thus, registration member 78 pivots from the inoperative position, wherein planar surface 80 is spaced from the path of movement of the advancing sheet, to the operative position, wherein planar surface 80 is in the path of movement of the advancing sheet. As shown in FIG. 3, planar surface 80 prevents the passage of sheet 54 from chute 40. As feed roll 38 continues to rotate after sheet 54 engages planar surface 80 and forms a buckle therein. Thus, the formation of the buckle in sheet 54 results in the alignment thereof.

Chain 42, which is mounted on a pair of opposed spaced sprocket rollers 90, continues to advance in the direction of arrow 66. Sprocket rollers 90 are interconnected to the drive system so as to advance chains 42. As gripper 44 continues to advance on chain 42, bar 62 is disengaged from cam 70. Spring 74 then pivots cam 70 in the direction of arrow 92 so as to return surface 76 into contact with registration member 78 pivoting registration member 78 such that surface 80 is no longer in the sheet path. The foregoing is shown in FIG. 4. As bar 62 is disengaged from cam 70, spring 74 rotates cam 70 in the direction of arrow 92. In this manner, surface 76 rather than surface 84 of cam 70 engages registration member 78. As surface 76 engages registration member 78, registration member 78 is pivoted in the direction of arrow 82 positioning planar surface 80 in the inoperative positions or spaced from the path of sheet movement. Thereafter, jaw 64 engages cam 68 and is depressed downwardly so as to be in the open position capable of receiving advancing sheet 54. As planar surface 80 moves out of the path of movement of sheet 54, the buckle induced therein causes the leading edge of sheet 54 to move in a forward direction from chute 40 into opened jaw 64. As gripper 44 continues to move in the direction of arrow 66, jaw 64 moves from beneath cam 68 and returns to the closed position securing sheet 54 thereto. Thus, sheet 54 is drawn from chute 40 with registration member 78 being spaced therefrom.

It should be noted that registration member 78 remains spaced from the path of sheet movement and exerts no drag force on the advancing sheet 54. Moreover, a high spring force may be employed to insure that the advancing sheet 54 does not pivot registration gate 78 out of the path of movement during the alignment process.

In recapitulation, drag on the advancing sheet is minimized and the alignment thereof can be maximized by the utilization of the improved sheet feeding apparatus described in the present invention. As hereinbefore indicated, this apparatus includes a registration member adapted to move from an inoperative position, spaced from the path of movement of the advancing sheet, to an operative position, in the path of movement of the advancing sheet. In this manner, the advancing sheet contacts the registration member and is aligned thereby. After registration, the registration member moves from the operative position to the inoperative position and the sheet is advanced into grippers for movement to the delivery station. Thus, the apparatus of the present invention facilitates sheet feeding and ready alignment of the advancing sheet. In addition, multiple sheet jams and misfeeds are prevented.

It is, therefore evident that there has been provided in accordance with the present invention, an improved sheet feeding apparatus that fully satisfies the objects, aims and advantages set forth above. While this invention has been described in conjunction with a specific embodiment thereof, it is evident that many alternatives, modifications and variations will be apparent to those skilled in the art. Accordingly, it is intended to embrace all alternatives, modifications and variations that fall within the spirit and broad scope of the appended claims.

What is claimed is:

1. A sheet feeding apparatus of the type being arranged to separate and advance successive sheets from a stack thereof, wherein the improvement includes;

a normally closed sheet gripping member;

means for advancing said sheet gripping member;

means for aligning successive sheets, said aligning means includes a frame, a registration member having a generally planar surface extending transversely to the path of sheet movement, said registration member being mounted pivotably on said frame, and biasing means, for resiliently urging said registration member to pivot from the inoperative position, wherein the planar surface thereof is spaced from the path of sheet movement, to the operative position, wherein the planar surface thereof extends transversely to the path of sheet movement;

means, responsive to said advancing means moving said sheet gripping member to a first preselected position, for moving said aligning means from an inoperative position spaced from the path of movement of the advancing sheet to an operative position in the path of movement of the advancing sheet so that the leading edge of the sheet engages said aligning means, said moving means includes a first cam member mounted pivotably on said frame member and in engagement with said registration member, said cam member having a profile such that in a first position the planar surface of said registration member is spaced from the path of sheet movement and in the second position the planar surface of said registration member extends transversely to the path of sheet movement, and biasing means resiliently urging said first cam member to pivot from the second position to the first position; and means for opening said sheet gripping member in response to said advancing means moving said sheet gripping member to a second preselected position, said moving means returning said aligning means to the inoperative position in response to said gripping member being at the second preselected position so that the opened sheet gripping member receives the leading edge of the sheet.

2. A sheet feeding apparatus as recited in claim 1, wherein:

said advancing means includes a pair of opposed, spaced sprocket rollers, and a pair of opposed, spaced endless chains entrained about the sprocket rollers; and said sheet gripping member includes a gripper jaw mounted on the pair of chains, and means for resiliently urging the gripper jaw to a closed position.

3. A sheet feeding apparatus as recited in claim 2, wherein said opening means includes a second cam member arranged to engage said gripping member to open the jaws thereof for receiving the leading edge of the sheet.

4. An electrostatographic printing machine of the type having a powder image developed on an image bearing member and an apparatus for advancing and separating successive sheets from a stack thereof, wherein each powder image is transferred from the image bearing member to successive advancing sheets, wherein the improvement includes:

a normally closed sheet gripping member;

means for advancing said sheet gripping member;

means for aligning each advancing sheet, said aligning means includes a frame member, a registration member having a generally planar surface extending transversely to the path of sheet movement, said registration member being mounted pivotably on said frame member, and biasing means for resiliently urging said registration member to pivot from an inoperative position wherein the planar surface thereof is spaced from the path of sheet movement, to the operative position, wherein the planar surface thereof extends transversely to the path of sheet movement;

means, responsive to said advancing means moving said sheet gripping member to a first preselected position, for moving said aligning means from an inoperative position spaced from the path of movement of the advancing sheet to an operative position in the path of movement of the advancing sheet so that the leading edge of the sheet engages said aligning means, said moving means includes a first cam member mounted pivotably on said frame member and in engagement with said registration member, said first cam member having a profile such that in a first position the planar surface of said registration member is spaced from the path of sheet movement and in the second position the planar surface of said registration member extends transversely to the path of sheet movement, and biasing means for resiliently urging said first cam member to pivot from the second position to the first position; and means for opening said sheet gripping member in response to said advancing means moving said sheet gripping member to a second preselected position, said moving means returning said aligning means to the inoperative position in response to said gripping member being at the second preselected position so that the opened sheet gripping member receives the leading edge of the sheet.

5. A printing machine as recited in claim 4, wherein:

said advancing means includes a pair of opposed spaced sprocket rollers, and a pair of opposed, spaced endless chains entrained about the sprocket rollers; and said sheet gripping member includes a gripper jaw mounted on the pair of chains, and means for resiliently urging the gripper jaw to a closed position.

6. A printing machine as recited in claim 5, wherein said opening means includes a second cam member arranged to engage said gripping member to open the jaws thereof for receiving the leading edge of the sheet.

* * * * *